US009624566B2

(12) United States Patent
Kawakami et al.

(10) Patent No.: US 9,624,566 B2
(45) **Date of Patent: *Apr. 18, 2017**

(54) ALPHA AND BETA TITANIUM ALLOY SHEET EXCELLENT IN COLD ROLLABILITY AND COLD HANDLING PROPERTY AND PROCESS FOR PRODUCING THE SAME

(75) Inventors: Akira Kawakami, Tokyo (JP); Hideki Fujii, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 603 days.

This patent is subject to a terminal disclaimer.

(21) Appl. No.: 14/001,434

(22) PCT Filed: Feb. 24, 2012

(86) PCT No.: PCT/JP2012/054625

§ 371 (c)(1),
(2), (4) Date: Aug. 23, 2013

(87) PCT Pub. No.: WO2012/115242

PCT Pub. Date: Aug. 30, 2012

(65) Prior Publication Data

US 2013/0327449 A1 Dec. 12, 2013

(30) Foreign Application Priority Data

Feb. 24, 2011 (JP) ..... 2011-038510

(51) Int. Cl.
*C22C 14/00* (2006.01)
*C22F 1/18* (2006.01)
*C22F 1/00* (2006.01)

(52) U.S. Cl.
CPC ..... *C22F 1/183* (2013.01); *C22C 14/00* (2013.01); *C22F 1/00* (2013.01)

(58) Field of Classification Search
CPC ..... C22C 14/00; C22F 1/183; C22F 1/00
(Continued)

(56) References Cited

U.S. PATENT DOCUMENTS

2003/0196735 A1 10/2003 Sugiura et al.

FOREIGN PATENT DOCUMENTS

CN 1462317 A 12/2003
EP 1382695 A1 1/2004
(Continued)

OTHER PUBLICATIONS

International Search Report issued in PCT/JP2012/054625, dated May 29, 2012.

(Continued)

*Primary Examiner* — Jessee Roe
*Assistant Examiner* — Jenny Wu
(74) *Attorney, Agent, or Firm* — Birch, Stewart, Kolasch & Birch, LLP

(57) ABSTRACT

An α+β type hot-rolled titanium alloy sheet, wherein: (a) ND represents the normal direction of a hot-rolled sheet; RD represents the hot rolling direction; TD represents the hot rolling width direction; θ represents the angle formed between the orientation of c axis and the ND; Φ represents the angle formed between a plane including the orientation of the c axis and the ND, and a plane including the ND and the TD; (b1) XND represents the highest (0002) relative intensity of the X-ray reflection caused by crystal grains when θ is from 0° to 30° and Φ is within the entire circumference; (b2) XTD represents the highest (0002) relative intensity of the X-ray reflection caused by crystal grains when θ is from 80° to 100° and Φ is ±10°. (c) The α+β type titanium alloy sheet has a value for XTD/XND of at least 5.0.

2 Claims, 4 Drawing Sheets

(58) Field of Classification Search
USPC ..... 148/421, 501
See application file for complete search history.

(56) References Cited

FOREIGN PATENT DOCUMENTS

| | | | | |
|---|---|---|---|---|
| JP | 61-44167 | A | | 3/1986 |
| JP | 8-295969 | A | | 11/1996 |
| JP | 10-94804 | A | | 4/1998 |
| JP | 10-265876 | A | | 10/1998 |
| JP | 10265876 | A | * | 10/1998 |
| JP | 2010-31314 | A | | 2/2010 |
| JP | 2010-255026 | A | | 11/2010 |
| JP | 2010255026 | A | * | 11/2010 |
| TW | I-293987 | B | | 3/2008 |

OTHER PUBLICATIONS

Taiwanese Office Action dated Sep. 3, 2014 for Taiwanese Application No. 101106307.
Taiwanese Office Action for Taiwanese Application No. 101106307, dated Jan. 21, 2016.

* cited by examiner

ALPHA AND BETA TITANIUM ALLOY SHEET EXCELLENT IN COLD ROLLABILITY AND COLD HANDLING PROPERTY AND PROCESS FOR PRODUCING THE SAME

TECHNICAL FIELD

The present invention relates to an α+β titanium alloy sheet, which is excellent in manufacturability, for example, such that a crack is less liable to be developed in the sheet width direction in a coil during cold rolling or after cold working and the deformation resistance thereof during the cold rolling is low, and a process for producing the same.

BACKGROUND ART

Hitherto, an α+β titanium alloy has been used as an aircraft member by utilizing its high specific strength. In recent years, the weight ratio of a titanium alloy to be used in aircraft members is increasing, and this alloy may become more and more important. In addition, for example, also in the consumer products field, an α+β titanium alloy which is characterized by high Young's modulus and light specific gravity thereof, may be often used for the application to a golf club face, etc.

Further, the high-strength α+β titanium alloy may be expected to find its future application in an automotive component wherein a reduction in the weight thereof is important, in a geothermal well casing requiring corrosion resistance and specific strength, and the like. In particular, the titanium alloy may be used in the form of a sheet in many cases, and therefore, the needs for high-strength α+β titanium alloy sheet may be high.

As the α+β titanium alloy, Ti-6% Al-4% V alloy (herein, "%" is mass %, in the same manner hereinafter) may be most widely used and a representative alloy, but this alloy cannot be cold-rolled because of its high strength and low ductility and is generally produced by hot sheet rolling or hot pack rolling. However, precise accuracy of the sheet thickness can hardly be achieved in the hot sheet rolling or hot pack rolling, and in such a production process, the production yield of the product is low, and it is difficult to produce a high-quality thin sheet product with a low cost.

For the purpose of solving such a problem, several α+β titanium alloys capable of producing a cold-rolled strip have been proposed.

Patent Documents 1 and 2 propose a low alloyed α+β titanium alloy containing Fe, O and N as main alloying elements. This titanium alloy is composed of Fe as a β stabilizing element and inexpensive elements O and N as α stabilizing elements in proper ranges and it shows a high strength and ductility balance. In addition, the above titanium alloy has high ductility at room temperature and therefore, it is an alloy also capable of producing a cold-rolled sheet product.

Patent Document 3 discloses a technique where Al contributing to the achievement of high strength but decreasing ductility so as to reduce the cold workability is added and, on the other hand, Si or C which is effective in increasing the strength, but does not deteriorate the cold rollability is added, to thereby enable cold rolling. Each of Patent Documents 4 to 8 discloses a technique for enhancing mechanical characteristics by adding Fe and O and controlling the crystal orientation, grain size or the like.

However, in practice, there is posed a problem that at the time of cold-rolling an α+β titanium alloy coil to a certain degree of rolling reduction or more, a crack along the sheet width direction starting from a so-called edge cracking, to cause a fracture through the width direction of the sheet (hereinafter, referred to as "sheet fracture") in some cases.

When the sheet fracture occurs, the fractured sheet must be removed from the production line, and the production may be inhibited because of the reason, for example, that the removal thereof takes time, etc., and the production efficiency is reduced. Further, a safety problem may arise, for example, such that the sheet itself or a piece of the fractured sheet may come to fly suddenly due to the impact upon the fracturing.

Further, the sheet may significantly e deformed near a portion where the fracture has occurred in the sheet, and the portion cannot be used as a product in many cases. As a result, the production yield may be dropped, and the coil may be reduced in the unit mass, so as to further decrease the production efficiency and yield.

In addition, an alloying element is added to an alloy so as to impart high strength to the alloy, and accordingly the deformation resistance at room temperature is high, and a heavy load is required so as to decrease the sheet thickness by cold rolling. In particular, in an α+β titanium alloy, when the material for cold rolling has a hot-rolled texture where the basal plane of the titanium α phase is oriented in the direction close to the normal direction of the sheet surface (i.e., a texture called "Basal-texture"; hereinafter referred to as "B-texture"), the deformation in the sheet thickness direction becomes difficult.

In such a case, it is not easy to ensure a high reduction in sheet thickness during cold rolling (%) (={(sheet thickness before cold rolling−sheet thickness after cold rolling)/(sheet thickness before cold rolling)}·100) by one-time-cold-rolling-process, and depending on the sheet thickness of the final product, once or several times of intermediate annealing process(es) is(are) needed during the cold rolling processes. As a result, the number of cold rolling operations should be increased, so as to reduce the production efficiency.

Patent Document 9 discloses a technique where in commercially pure titanium, the grains are refined and hot rolling is started in β single phase region so as to prevent the generation of wrinkles or scratches. Patent Document 10 discloses an α+β casting titanium alloy of Ti—Fe—Al—O system for a golf club head. Patent Document 11 discloses an α+β titanium alloy of Ti—Fe—Al system.

Patent Document 12 discloses a titanium alloy for a golf club head, where the Young's modulus is controlled by a final finish heat treatment. Non-Patent Document 1 discloses a technique for forming a texture in pure titanium through heating to β region and subsequent uni-directional rolling in the α region.

However, these techniques are not intended to suppress the development of cracking in the sheet width direction in a coil during and after the cold rolling and further, to reduce the deformation resistance at the time of the cold rolling.

Accordingly, there has been demanded an α+β titanium alloy sheet having good handling property such that, in a coil, for example, a crack is less liable to be developed in the sheet width direction during and after the cold rolling, and the deformation resistance during the cold rolling is low.

PRIOR ART DOCUMENTS

Patent Documents

[Patent Document 1] Japanese Patent No. 3 426 605
[Patent Document 2] Japanese Unexamined Patent Publication (JP-A; Kokai) No. 10-265876
[Patent Document 3] JP-A No. 2000-204425
[Patent Document 4] JP-A No. 2008-127633
[Patent Document 5] JP-A No. 2010-121186
[Patent Document 6] JP-A No. 2010-31314
[Patent Document 7] JP-A No. 2009-179822
[Patent Document 8] JP-A No. 2008-240026
[Patent Document 9] JP-A No. 61-159562
[Patent Document 10] JP-A No. 2010-7166
[Patent Document 11] JP-A No. 07-62474
[Patent Document 12] JP-A No. 2005-220388

Non-Patent Documents

[Non-Patent Document 1] *Titanium*, Vol. 54, No. 1, pp. 42-51 (The Japan Titanium Society, issued on Apr. 28, 2006)

SUMMARY OF THE INVENTION

Problem to be Solved by the Invention

Under these circumstances, a problem to be solved by the present invention is, in the production of an α+β titanium alloy sheet, to suppress the occurrence of sheet fracture due to the development of edge cracking during or after the cold rolling, and to maintain a high sheet thickness reduction ratio (%), and an object of the present invention is to provide an α−β titanium alloy sheet and a process for producing the same, which can solve the above problem.

Means for Solving the Problem

In order to solve the above problem, the present inventors have taken note of the hot-rolling texture greatly affecting the ductility and have made intensive studies on the relationship between the development of cracking in the sheet width direction and the hot-rolled texture in an α+β titanium alloy sheet. As a result, the present inventors have made the following discovery.

(x) When the crystal structure stabilizes a hot-rolling texture (a texture called "Transverse-texture"; hereinafter, referred to as "T-texture") in which the normal direction of a hexagonal basal plane ((0001) plane), that is, the c-axis orientation, of a titanium α phase of a hexagonal close-packed structure is strongly oriented in the TD (width direction of the hot rolled sheet), a coil during or after the cold rolling is kept from the development of cracking in the sheet width direction and is less liable to cause the sheet fracture.

(y) When the T-texture is stabilized, the deformation resistance during the cold rolling is reduced and the ductility in the longitudinal direction is increased, and as a result, the handling property of the coil at the time of the cold uncoiling and/or recoiling is enhanced.

These discoveries will be described in detail hereinafter.

The present invention has been accomplished based on the above discoveries, and the gist of the present invention resides in the followings.

[1] An α+β titanium alloy sheet excellent in cold rollability and cold coil handling property, wherein:

(a) the normal direction of a hot-rolled sheet is taken as ND, the hot rolling direction is taken as RD, the hot-rolling width direction is taken as TD, the normal direction of the α-phase (0001) plane is taken as c-axis orientation, the angle formed between the c-axis orientation and the ND is taken as θ, and the angle formed between a plane including the c-axis orientation and the ND, and a plane including the ND and the TD is taken as Φ;

(b1) among (0002) relative reflection intensities of X-ray by grains where θ is 0° or more and 30° or less, and Φ falls in the entire circumference (−180 to 180°), the maximum intensity is taken as XND;

(b2) among (0002) relative reflection intensities of X-ray caused by grains where θ is 80° or more and less than 100°, and Φ falls in ±10°, the maximum intensity is taken as XTD; and (c) XTD/XND is 5.0 or more.

[2] The α+β titanium alloy sheet excellent in cold rollability and cold coil handling property according to [1], wherein the α+β titanium alloy sheet comprises, in mass %, Fe: 0.8 to 1.5% and N: 0.020% or less, and contains O, N and Fe to satisfy the condition that Q (%) defined by the following formula (1) is 0.34 to 0.55, with the balance being Ti and unavoidable impurities:

$$Q(\%)=[O]+2.77\cdot[N]+0.1\cdot[Fe] \quad (1)$$

wherein [O]: the content (mass %) of O,

[N]: the content (mass %) of N, and

[Fe]: the content (mass %) of Fe.

[3] A process for producing an α+β titanium alloy sheet excellent in cold reliability and cold handling property according to [1] or [2], wherein:

at the time of hot-rolling an α+β titanium alloy, the titanium alloy prior to hot rolling is heated to a temperature ranging of (β transformation temperature +20° C.) or more and (β transformation temperature +150° C.) or less, and is hot-rolled uni-directionally by setting the hot rolling finishing temperature to be (β transformation temperature −200° C.) or more and (β transformation temperature −50° C.) or less, such that the sheet thickness reduction ratio defined by the following formula becomes 90% or more:

Sheet thickness reduction ratio (%)={(sheet thickness prior to cold rolling−sheet thickness after cold rolling)/(sheet thickness prior to cold rolling)}·100

Effect of the Invention

The present invention can provide an α+β titanium alloy sheet such that the sheet fracture due to a crack initiating from edge cracking or the like and propagation in the TD is less liable to occur, for example, during the cold rolling or in the uncoiling/recoiling step after the cold rolling and, the deformation resistance during the cold rolling is small, so as to keep a high sheet thickness reduction ratio.

BRIEF DESCRIPTION OF THE DRAWINGS

FIG. 1(*a*) is a view showing a crystal grain (hatching part) where θ formed between the c-axis orientation and the ND is from 0 to 30°, and Φ falls in the entirety of circumference (from −180 to 180°).

FIG. 1(*c*) is a view showing a crystal grain (hatching part) where θ formed between the c-axis orientation and the ND is from 80 to 100° and Φ falls in ±10°.

MODES FOR CARRYING OUT THE INVENTION

As described above, the present inventors have taken notice of a hot-rolling texture having a much effect on ductility, and have made intensive studies on the relationship between crack development in the sheet width direction and hot-rolling texture in an α+β titanium alloy sheet. As a result, the following discoveries (x) and (y) are obtained, which are described in detail below.

Figure 1A:
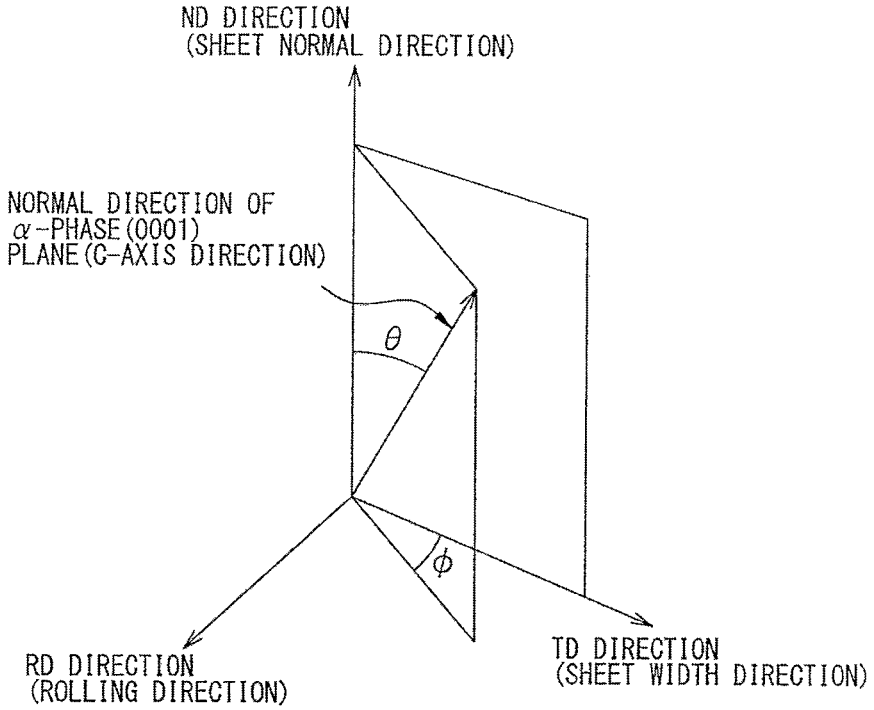
FIG. 1(*a*) is a view showing a relative directional relationship between crystal orientation and the surface of a sheet.
Figure 1B:
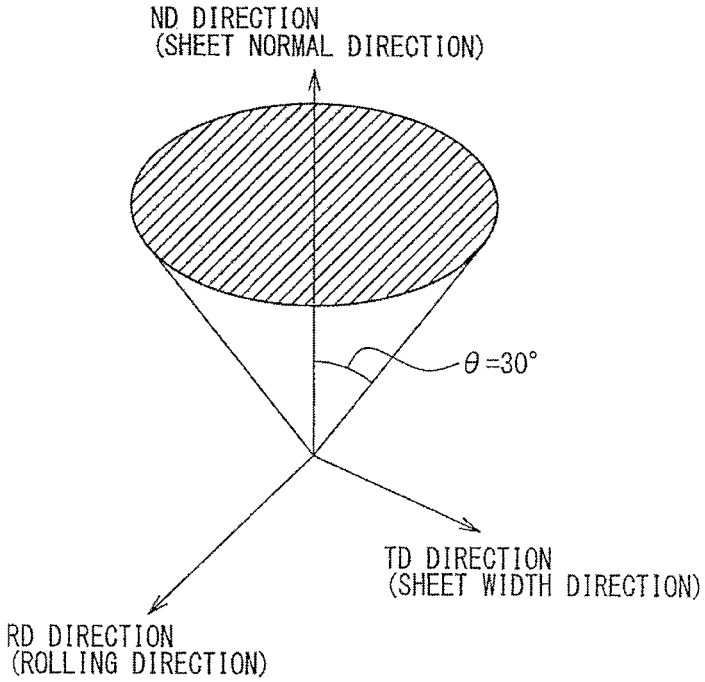
Figure 1C:
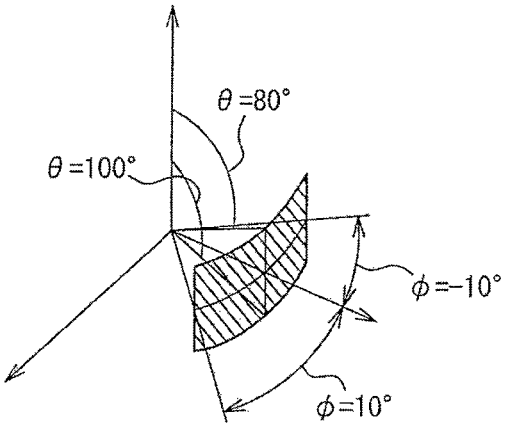

First, FIG. 1(*a*) shows a relative directional relationship between the crystal orientation and the sheet surface. The normal direction of a hot-rolled surface is taken as ND, the hot rolling direction is taken as RD, the hot-rolling width direction is taken as TD, the normal direction of the α-phase (0001) plane is taken as c-axis orientation, the angle formed between the c-axis orientation and the ND is taken as θ, and the angle formed between a plane including the c-axis orientation and the ND, and a plane including the ND and the TD is taken as Φ.

As a result of the present inventors' studies, described hereinabove, it has been found that, when the crystal structure has a hot-rolling texture (T-texture), where c-axis of a titanium α phase composed of a hexagonal close-packed structure (hereinafter, sometimes referred to as "HCP") is strongly oriented in the sheet width direction(TD), a crack directed to propagate in the sheet width direction has a tendency to be slanted halfway.

That is, the present inventors have found that, in an α+β titanium alloy having T-texture, the basal plane of the HCP is strongly oriented in the direction parallel to the sheet width direction, or in a direction close thereto; and at this time, when a crack is intended to be developed along the sheet width direction, plastic relaxation occurs at the distal end of the crack, and the crack propagation direction is changed from the sheet width direction to the direction close to the longitudinal direction of the sheet.

In particular, in an α+β titanium alloy having T-texture and having ductility, there is liable to occur a phenomenon that a crack in the sheet width direction is slanted toward the longitudinal direction of the sheet due to the plastic relaxation at the crack distal end. In this way, at the time of applying continuous annealing or the like to a coil during or after the cold rolling, even when a crack starting from edge cracking generated for some reason is intended to propagate in the sheet width direction, the crack is readily caused to be slanted toward the longitudinal direction of the sheet in a sheet having T-texture.

As a result, as compared with the sheet not being composed of T-texture and hardly allowing a crack to be slanted toward the sheet width direction, the fracture path is prolonged and therefore, sheet fracture is less liable to occur, That is, in a titanium alloy sheet having a T-texture, as compared with a titanium alloy sheet having no strong T-texture and hardly causing the bending of a crack, the fracture path of a crack may become longer, that is, the path leading to fracture may be lengthened, and as a result, the sheet fracture is less liable to occur.

The present inventors have compared and evaluated the degree of accumulation of the HCP basal plane in the sheet width direction and the degree of bending of a crack having a tendency to propagate in the sheet width direction, and have found that, as the T-texture is more stabilized, there is less liable to cause a phenomenon that a crack has a tendency to propagate straight in the sheet width direction.

This is because, along with the stabilization of T-texture, the HCP basal plane is more strongly oriented in the sheet width direction so that the crack is more liable to make a detour to the longitudinal direction of the sheet, and as a result, a crack generated along the sheet width direction is slanted toward the longitudinal direction of the sheet and the fracture path is lengthened.

In the evaluation of insusceptibility to crack propagation, a V-notch in a direction corresponding to the sheet width direction is machined in a Charpy impact test specimen so that the rolling direction of an alley sheet corresponds to the longitudinal direction of the specimen, and then a Charpy impact test is performed at room temperature, and the insusceptibility to crack propagation in the TD of a hot-rolled sheet can be evaluated by the length of a crack developed from the notch bottom.

Figure 5:
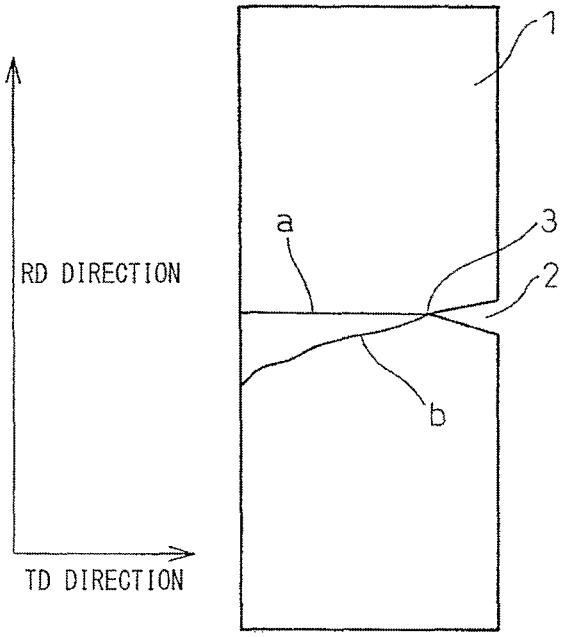
FIG. 5 is a view showing fracture path in a Charpy impact test piece.

Here, FIG. 5 shows a fracture path in a Charpy impact test specimen. As shown in FIG. 5, when the length of a perpendicular line drawn down vertically with respect to the longitudinal direction of the specimen from the notch bottom 3 of a notch 2 formed in the Charpy impact test specimen 1 is "a" and the length of a crack actually propagated is "b", the ratio (=b/a) therebetween is defined as an "inclination index" in the present invention. When the inclination index exceeds 1.20 (more preferably, exceeds 1.25), the sheet fracture in the width direction of a hot-rolled sheet is less liable to occur.

In this connection, a crack propagating in the specimen may not always proceed in one specific direction, but may proceed in a zigzag manner. In either of these cases, "b" indicates the entire length of the fracture path.

Further, when T-texture is stabilized, the strength in the longitudinal direction of the sheet is reduced to facilitate the cold rolling, and the sheet thickness reduction ratio can be increased. This is because, when T-texture is strengthened, prismatic slip is mainly activated among the primary slip systems. With the progress of deformation, the sheet thickness is decreased, as a characteristic of plastic deformation behavior during the cold rolling. The rise in the work hardening coefficient during the deformation by this slip system is small, as compared with those of other slip systems and therefore, an abrupt increase in the deformation resistance is avoided.

With respect to the relationship between anisotropy in the strength and the texture in the sheet, Non-Patent Document 1 disclose that, in the case of commercially pure titanium as an example, anisotropy in the yield strength is larger in T-texture than that in B-texture. In the case of commercially pure titanium, the yield strength in the sheet width direction hardly differs between B-texture and T-texture, but the yield strength in the longitudinal direction of the sheet is rarely different therebetween.

However, in the case of an α+β titanium alloy, when T-texture is stabilized, the strength in the longitudinal direction is slightly decreased, as compared with that in the case of commercially pure titanium. This is caused because, when titanium is cold worked (for example, cold rolled) at a temperature in the vicinity of room temperature, the main slip plane is limited to the basal plane, and in the case of commercially pure titanium, in addition to the slip deformation, twinning deformation occurs so that the twin direction corresponds to a direction close to the c-axis of HCP, and as a result, the plastic anisotropy of commercially pure titanium is smaller than that of a titanium alloy.

In the case of an α+β titanium alloy containing O, Al and the like, unlike the case of commercially pure titanium, twin deformation is restricted, and the slip deformation predominates and therefore, along with the formation of a strong texture, the basal plane is oriented in a certain direction, and as a result, in-plane anisotropy in mechanical properties is further promoted.

In this way, the present inventors have found that, in an α+β titanium alloy, the stabilization of T-texture provides a slight reduction in the strength in the longitudinal direction and an enhancement of ductility, whereby the handling property of the α+β titanium alloy sheet is improved, The present inventors have further found that, to obtain an α+β titanium alloy with strong T-texture, it is effective to control the heating temperature prior to hot rolling in a specific temperature range in the β single-phase region, and when the hot-rolling starting temperature is set in the β single-phase region, this is more effective in the formation of a strong T-texture.

This temperature range is higher than the normal hot rolling temperature of an α+β titanium alloy (α+β two-phase region-heating hot-rolling temperature) and therefore, there is provided an effect that not only good hot workability is maintained, but also the temperature drop in both of the edge of the sheet during the hot rolling is small, whereby the edge cracking is less liable to occur.

In this way, the present invention is also advantageous in that the generation of edge cracking in a hot-rolled coil is suppressed, and therefore the amount of a trimmed-off from both edges at the time of cutting out (trimming) can be small, and the decrease in the production yield can be reduced.

Further, the present inventors have found that, when the content of Fe as an inexpensive element and the contents of Fe, O and N are regulated based on the following formula (1), T-texture can easily be built up, while maintaining the strength. The details of component composition and the following formula (1) are described later.

$$Q=[O]+2.77\cdot[N]+0.1\cdot[Fe] \quad (1)$$

As described hereinabove, Patent Document 3 discloses that the cold workability is enhanced by the effect of Si or C addition. However, the hot rolling conditions therein may show that, although the heating to β region is applied, the rolling is performed in the α+β region, and the enhancement of cold workability is not attributable to a texture such as T-texture.

Non-Patent Document 1 discloses that, after heating commercially pure titanium to the β temperature region, a texture analogous to T-texture is formed, but because of commercially pure titanium, unlike the production process according to the present invention, the rolling is started in the α temperature region. In addition, Non-Patent Document 1 does not describe the effect of suppressing a crack during the hot rolling.

Similarly, Patent Document 9 discloses a technique of starting the hot rolling commercially pure titanium in the β temperature region, but the purpose of this technique is to prevent the generation of wrinkles or scratches by decreasing the size of the crystal grain, and accordingly, the purpose of this technique greatly differs from the object of the present invention. In addition, Patent Document 9 does not disclose the evaluation of a texture or the inhibition of cracking.

The present invention is intended for an α+β alloy containing, in mass %, 0.5 to 1.5% of Fe and containing Fe, O and N in defined amounts. Accordingly, the present invention is substantially different from the techniques relating to pure titanium or a titanium alloy close to pure titanium.

Patent Document 10 discloses an α+β titanium alloy of Ti—Fe—Al—O system for a golf club head, but this titanium alloy is a casting titanium alloy and is substantially different from the titanium alloy according to the present invention. Patent Document 11 discloses an α+β titanium alloy containing Fe and Al, but there is no disclosure about the evaluation of texture or the inhibition of cracking during cold rolling. Accordingly, this alloy is technically significantly different from that according to the present invention in this point.

Patent Document 12 discloses a titanium alloy for a golf club head, having a component composition which is similar to that according to the present invention. However, this technique is characterized by controlling the Young's modulus by a final heat treatment, and this document does not disclose the hot rolling conditions, the texture and handling property of the hot-rolled sheet coil.

After all, the techniques disclosed in Patent Documents 10 to 12 are different from that of the present invention in view of the object and characteristic features.

As described above, the present inventors have investigated in detail the effect of a hot-rolling texture on the cold formability of a titanium alloy coil, and as a result, the present inventors have found that, when T-texture is stabilized, a coil during or after the cold rolling is kept from crack development in the sheet width direction and is less liable to cause sheet fracture. Further, the deformation resistance during the cold rolling is low and the ductility in the longitudinal direction is improved, and therefore the handling property at the time of the uncoiling is enhanced. The present invention has been accomplished based on this discovery. Hereinbelow, the present invention will be described in detail.

The reasons for the limitation of the texture of titanium α phase in the α+β titanium alloy sheet according to the present invention (hereinafter, sometimes referred to as "hot-rolled sheet according too the present invention") are described below.

In α+β titanium alloy, the effect of inhibiting sheet fracture, which is caused by the crack propagation in the sheet width direction during the cold rolling or in a cold-rolled sheet, is exerted when T-texture grows strongly. The present inventors have proceeded with intensive studies on the alloy design for growing T-texture and the texture forming conditions and have solved in the following manner.

First, the degree of the texture growth was evaluated by using a ratio of (0002) relative reflection intensities of X-ray, which are reflection from the α-phase basal plane ((0001) plane) and obtained by the X-ray diffraction method.

Figure 2:
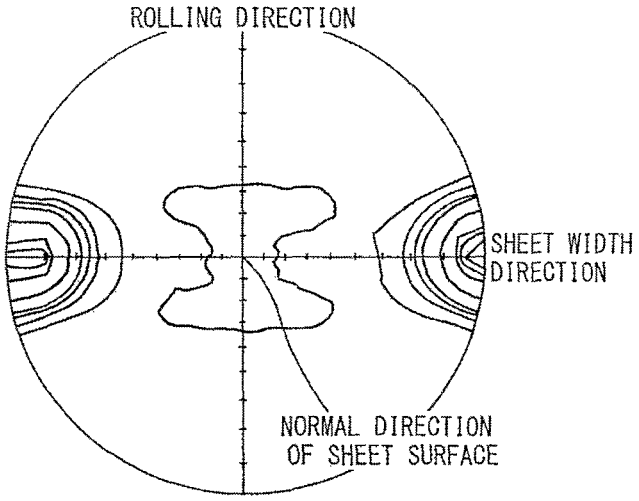
FIG. 2 is a view showing an example of the (0002) pole figure indicating the orientation distribution of the α-phase (0002) plane.

FIG. 2 shows an example of the (0002) pole figure indicating the accumulation direction of the α-phase basal plane ((0001) plane). This (0002) pole figure is a typical example of T-texture, and it is seen from FIG. 2 that the α-phase basal plane ((0001) plane) is strongly oriented in the sheet width direction.

In such a (0002) pole figure, a ratio (=XTD/XND) between the peak value (XTD) of relative X-ray intensities in a direction close to the sheet width direction, and the peak value (XND) of relative X-ray intensities in a direction close to the sheet surface normal direction was evaluated for various titanium alloy sheets.

Figure 3:
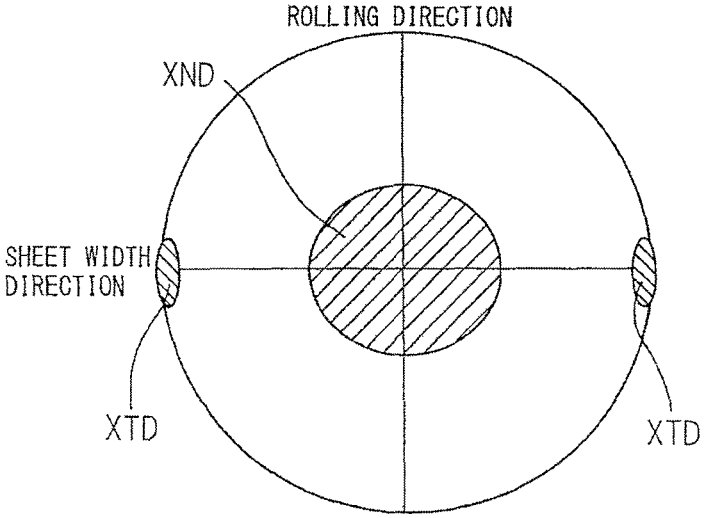
FIG. 3 is view showing regions corresponding to the hatching parts of FIG. 1(*b*) and FIG. 1(*c*) in the (0002) pole figure of the titanium α phase.

Here, FIG. 3 schematically shows the measurement positions of XTD and XND in the (0002) pole figure. In the case of the measurement of the texture of a rolled sheet surface, when the texture in the sheet surface direction is analyzed by X-ray, (a) XTD is the peak value of relative X-ray intensities within an azimuth angle inclined by 0 to 10° toward the sheet normal direction from the sheet width direction on the (0002) pole figure of titanium, and an azimuth angle rotated by ±10° from the sheet width direction around the sheet normal direction, and (b) XND is the peak value of relative X-ray intensities within an azimuth angle inclined by 0 to 30° toward the sheet width direction from the sheet normal direction and an azimuth angle rotated about the entire circumference around the sheet normal direction.

The ratio (=XTD/XND) between those two values is defined as the X-ray anisotropy index, and the T-texture stability can be evaluated by the index and is associated with the easiness of cold rolling. At this time, a value obtained by dividing the hardness of a cross-section perpendicular to the TD by the hardness of a cross-section perpendicular to the RD is used as the indication of the easiness of cold rolling. As this value is smaller, the deformation in the sheet longitudinal direction is less liable to occur, that is, the cold rolling is less liable to be practiced.

Figure 4:
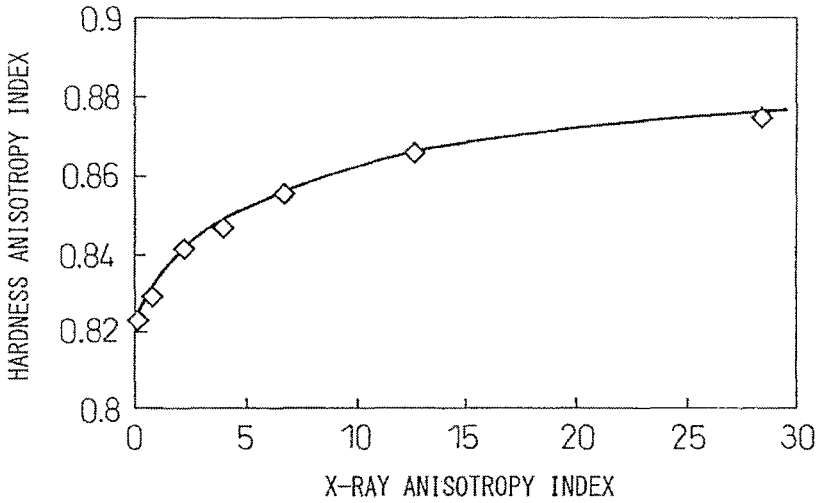
FIG. 4 is a view showing the relationship between the X-ray anisotropy index and the hardness anisotropy index.

FIG. 4 shows the relationship between the X-ray anisotropy index and the hardness anisotropy index. As the X-ray anisotropy index is higher, the hardness anisotropy index becomes larger. The deformation resistance during the cold rolling and the easiness of the cold rolling were examined by using the same material, and as a result, it has been found that, when the hardness anisotropy index is 0.85 or more, the deformation resistance in the sheet thickness direction during the cold rolling is sufficiently reduced and the cold rollability is remarkably enhanced. At this time, the X-ray anisotropy index here is 5.0 or more, preferably 7.0 or more.

Based on this discovery, the lower limit of the ratio XTD/XND between the peak value XTD of relative X-ray intensities within an azimuth angle inclined by 0 to 10° toward the sheet normal direction from the sheet width direction on the (0002) pole figure, and an azimuth angle rotated by ±10° from the sheet width direction around the sheet normal direction, and the peak value XND of relative X-ray intensities within an azimuth angle inclined by 0 to 30° toward the sheet width direction from the sheet normal direction, and an azimuth angle rotated about the entire circumference around the sheet normal direction is set to 5.0.

The reasons for limiting the chemical composition of the hot-rolled sheet according to the present invention are described below. In the following, "%" concerning the chemical composition means "mass %".

Fe is an inexpensive element among β phase stabilizing elements and therefore, the β phase is solid-solution strengthened by adding Fe. In order to improve the cold rollability, strong T-texture should be obtained by a hot-rolling texture. For realizing this purpose, a β phase which is stable at a hot-rolling heating temperature should be obtained in an appropriate volume ratio.

Fe has a high β stabilizing ability as compared with other β stabilizing elements and can stabilize a β phase by the addition in a relatively small amount, so that the amount added thereof can be small as compared with other β stabilizing elements. Accordingly, the degree of solid-solution strengthening by Fe at room temperature is small, and the titanium alloy can maintain high ductility, and as a result, cold rollability can be ensured. For obtaining a stable β phase at an appropriate volume ratio in the hot-rolling temperature region, Fe should be added in an amount of 0.8% or more.

On the other hand, Fe is liable to segregate in Ti, and if it is added in a large amount, the solid-solution strengthening occurs and the ductility decreases, so as to reduce the cold rollability. In consideration of these effects, the upper limit of the amount of Fe to be added is set to 1.5%.

N forms a solid solution as an interstitial element in the α phase and exerts a solid-solution strengthening action. However, if it is added in excess of 0.020% by a normal method, for example, using a sponge titanium containing a high concentration of N, an undissolved inclusion called "LDI" is readily produced, and the yield of the product is reduced. For this reason, the upper limit of the amount of N to be added is set to 0.020%.

Similarly to the case of N, O forms a solid solution as an interstitial element in the α phase and exerts a solid-solution strengthening action. It has been found that, when Fe, O and N, each of which exerts the solid-solution strengthening action, are present together, Fe, O and N contribute to an increase in the strength according to the value Q defined by the following formula (1):

$$Q=[O]+2.77\cdot[N]+0.1\cdot[Fe] \quad (1)$$

wherein

[O]: the content (mass %) of O,

[N]: the content (mass %) of N, and

[Fe]: the content (mass %) of Fe.

In the formula (1), the coefficient 2.77 of [N] and the coefficient 0.1 of [Fe] are a coefficient indicating the degree of contribution to the increase in the strength, and are a value empirically determined based on a number of experimental data.

If the value Q is less than 0.34, the strength for providing a tensile strength of about 700 MPa or more, which is generally required of an α+β titanium alloy, cannot be obtained. On the other hand, if the value Q exceeds 0.55, the strength is excessively increased, and as a result, the ductility is decreased, and the cold rollability is slightly reduced. For this reason, the value Q has a lower limit of 0.34 and an upper limit of 0.55.

In this connection, Patent Document 4 discloses a titanium alloy having a chemical composition analogous to the hot-rolled sheet according to the present invention, but the titanium alloy of this document is substantially different from that according to the present invention in that the purpose thereof is mainly to reduce the material anisotropy as much as possible, so as to improve the cold stretch formability (in the alloy sheet according to the present invention, a high material anisotropy is secured by forming T-texture), and in that, as compared with the hot-rolled sheet according to the present invention, not only the O amount is small but also the strength level is low.

The process for producing the α+β titanium alloy sheet according to the present invention (hereinafter, sometimes referred to as "production process according to the present invention") will be described below. The production process according to the present invention is particularly a production process for improving the coil rollability by developing T-texture.

The production process according to the present invention is a process for producing a thin sheet having the crystal orientation and titanium alloy components of the hot-rolled sheet according to the present invention, and is characterized by performing uni-directional hot-rolling by setting the heating temperature prior to the hot rolling to be not less than (β transformation temperature +20° C.) and not more than (β transformation temperature +150° C.) and the finish temperature to be not less than (β transformation temperature −250° C.) and not more than (β transformation temperature −50° C.)

In order to form the hot-rolling texture as strong T-texture and ensure a high material anisotropy, it should be necessary that a titanium alloy is heated to the β single-phase region, held for 30 minutes or more, to thereby once form it into a β single-phase state, and further, is subjected to a rolling reduction as large as a sheet thickness reduction ratio of 90% or more, from the β single-phase region to the α+β two-phase region:

Sheet thickness reduction ratio (%)={(sheet thickness before cold rolling−sheet thickness after cold rolling)/(sheet thickness before cold rolling)}·100

The β transformation temperature can be measured by differential thermal analysis. By use of test pieces which have been produced by vacuum melting and forging 10 or more kinds of materials each in a small amount of the laboratory level, where the chemical composition containing Fe, N and O is changed within the range of the chemical composition to be produced, the β→α transformation starting temperature and the transformation finishing temperature are previously examined by using differential thermal analysis while gradually cooling each of test pieces from the β single-phase region of 1,100° C.

At the time of the actual production of at titanium alloy, whether the alloy is in the β single-phase region or in the α+β region can be judged on the spot (or in situ), from the chemical composition of the production material by measuring the temperature by use of a radiation thermometer.

At this time, if the heating temperature is lower than (the β transformation temperature +20° C.) or further, the hot rolling finishing temperature is less than (the β transformation temperature −200° C.), β→α phase transformation occurs halfway during the hot rolling, and as a result, a large rolling reduction is applied in a state having a high α phase fraction, whereby a rolling reduction in a two-phase state having a high β phase fraction becomes insufficient, and an adequate growth of T-texture cannot be achieved.

In addition, if the hot rolling finishing temperature becomes lower than the (β transformation temperature −200° C.), the hot deformation resistance is abruptly increased and the hot workability is reduced, and as a result, the edge cracking or the like is often generated so as to cause a reduction in the Production yield. For this reason, the lower limit of the heating temperature during the hot rolling should be (the β transformation temperature +20° C.), and the lower limit of the finishing temperature should be not lower than (the β transformation temperature −200° C.)

At this time, if the rolling reduction ratio (i.e., sheet thickness reduction ratio) from the β single-phase region to the α+β two-phase region is less than 90%, the strain introduced by hot rolling thereby is not sufficient, so that the uniform introduction of the stain throughout the sheet thickness is less liable to be obtained, and the T-texture may not be adequately developed in some cases. For this reason, the sheet thickness reduction ratio during the hot rolling should be 90% or more.

Further, if the heating temperature during the hot rolling exceeds (the β transformation temperature +150° C.), a β grain is abruptly coarsened. In this case, the hot rolling is mostly performed in the β single-phase region and the coarse β grain is stretched in the rolling direction so that the β→α phase transformation take place therefrom, and as a result, the T-texture can hardly grow.

Further, in such a case, the oxidation of the surface of the hot-rolled material vigorously proceeds, and there arises a production problem, for example, a scab or a scratch is readily produced on the hot-rolled sheet surface after the hot rolling. For this reason, the upper limit of the heating temperature during the hot rolling is set to (the β transformation temperature +150° C.), and the lower limit is set to (the β transformation temperature +20° C.)

Further, if the finishing temperature at the time of the hot rolling exceeds (the β transformation temperature −50° C.), the hot rolling is mostly performed in the β single-phase region, and the orientation integration of a recrystallized a grain from a deformed β grain may not be sufficient, so that the growth of the T-texture may be insufficient. For this reason, the upper limit of the finishing temperature at the hot rolling is set to (the β transformation temperature −50° C.)

On the other hand, if the finishing temperature is lower than (the β transformation temperature −250° C.), the effect of heavy rolling reduction in a region having a high α phase fraction becomes predominant, and an adequate growth of T-texture by the heating and hot rolling in the β single-phase region, which is intended in the present invention, may be inhibited. Further, at such a low finishing temperature, the resistance to hot deformation is abruptly increased so as to deteriorate the hot workability, and the edge cracking is readily generated, to thereby cause a reduction in the production yield. For this reason, the finishing temperature is set not lower than (the β transformation temperature −250° C.) and not higher than (the β transformation temperature −50° C.)

Further, in the hot rolling under the above-described conditions, the temperature is high as compared with the heating and hot rolling in the α+β region, which are performed under normal hot-rolling conditions for an α+β titanium alloy, and therefore, a drop in the temperature at both ends of the sheet is suppressed. In this way, those conditions are advantageous in that good hot workability is maintained even at both ends of a sheet and the generation of edge cracking is inhibited.

In this connection, the reason for performing the rolling only in one direction consistently from the start to the end of the hot rolling is to prevent crack development in the sheet width direction in a coil during or after the cold rolling, which is intended in the present invention, and, to efficiently obtain T-texture capable of maintaining a low deformation resistance during the cold rolling and of enhancing the ductility in the sheet longitudinal direction.

In this way, there can be obtained a titanium alloy thin-sheet coil which is less liable to cause sheet fracture in a coil during or after the cold rolling, and is easy to cold roll due to low strength in the sheet, longitudinal direction and further, is easy to recoil due to high ductility in the sheet longitudinal direction.

EXAMPLES

Hereinbelow, the present invention will be described by referring to Examples, but the conditions in Examples may be one condition example employed to confirm the practicability and effect of the present invention, and the present invention may not be limited to such a condition example. In the present invention, as long as the object of the present invention can be achieved, various conditions may be employed without departing from the gist of the present invention.

Example 1

A titanium material having the composition shown Table 1 was melted by vacuum arc melting, and the resultant melt was hot forged to form a slab, then heated at 940° C. and thereafter, was hot-rolled at a sheet thickness reduction ratio of 97%, to thereby obtain a 3-mm hot-rolled sheet. The hot-rolling finishing temperature was 790° C.

Thus obtained hot-rolled sheet was pickled so as to remove oxide scale, and a sample as a tensile test piece was taken therefrom, and then the tensile characteristics thereof were examined, and the texture in the sheet surface direction was measured by using X-ray diffraction (by use. RINT 25.00, mfd. by Rigaku Corporation; Cu—Kα, voltage: 40 kV, current: 300 mA).

In the (0002) plane pole figure, the ratio (XTD/XND) between the peak value STD of relative X-ray intensities within an azimuth angle inclined by 0 to 10° toward the sheet normal direction from the sheet width direction and an azimuth angle rotated by ±10° from the sheet width direction around the sheet normal direction (as shown in. FIG. 1(*c*)), and the peak value XND of relative X-ray intensities Within an azimuth angle inclined by 0 to 30° toward the sheet width direction from the sheet normal direction (as shown in FIG. 1(*b*)) and an azimuth angle rotated about the entire circumference around the sheet normal direction was taken as an X-ray anisotropy index. The degree of the texture growth was evaluated by using the index.

For the evaluation of the cold rollability, there was used a value (i.e., hardness anisotropy index), which had been obtained by dividing the hardness of a cross-section perpendicular to the TD in a hot-rolled sheet by the hardness of a cross-section perpendicular to the RD. When the hardness anisotropy index is 0.85 or less, the deformation resistance in the sheet thickness direction is small and therefore, the cold rollability can be evaluated as a good value.

In the evaluation of the insusceptibility to sheet fracture, an impact test was performed at ordinary temperature in accordance with JIS 22242 by using a Charpy impact test piece (with a 2-mm V-notch) sampled in the L direction from the titanium alloy sheet. The insusceptibility to sheet fracture was evaluated by using the ratio (i.e., fracture inclination index: b/a) between the length (b) of a fracture path in the test piece after the impact test, and the length (a) of a perpendicular line drawn down from the V-notch bottom.

FIG. 5 schematically shows the definition of the fracture inclination index. When the fracture inclination index exceeds 1.20, a crack directed having a tendency to develop in the sheet width direction proceeds obliquely so as to make the fracture path sufficiently long, and as compared with that in the case of 1.20 or less, the sheet fracture is hardly liable to occur. The fracture inclination index was evaluated by sampling impact test pieces from a hot-rolled sheet and a cold-rolled sheet having a percentage elongation (={(sheet length after reforming)−(sheet length before reforming)/(sheet length before reforming)}·100%) of 40%. The results of these characteristic evaluations are shown together in the following Table 1.

TABLE 1

| Test No. | Fe (mass %) | O (mass %) | N (mass %) | Q (mass %) | β Transformation temperature (° C.) | X-Ray Anisotropy Index (XTD/XND) | Tensile Strength in Sheet Longitudinal Direction (MPa) | Hardness Anisotropy Index (HV1(Z)/HV1(T)) | Fracture Inclination Index (hot-rolled sheet) | Fracture Inclination Index (40% cold-rolled sheet) | Remarks |
|---|---|---|---|---|---|---|---|---|---|---|---|
| 1 | 1.1 | 0.32 | 0.004 | 0.44 | 915 | 0.15 | 791 | 0.82 | 1.02 | 1.03 | Comparative Example |
| 2 | 0.9 | 0.28 | 0.005 | 0.38 | 914 | 1.39 | 765 | 0.84 | 1.05 | 1.06 | Comparative Example |
| 3 | 0.3 | 0.31 | 0.005 | 0.35 | 931 | 6.78 | 682 | 0.86 | 1.25 | 1.24 | Comparative Example |
| 4 | 0.9 | 0.39 | 0.005 | 0.49 | 926 | 12.85 | 822 | 0.86 | 1.32 | 1.33 | Invention |
| 5 | 1.3 | 0.33 | 0.005 | 0.47 | 912 | 21.64 | 831 | 0.87 | 1.38 | 1.37 | Invention |
| 6 | 1.9 | 0.33 | 0.005 | 0.53 | 903 | 7.16 | 867 | 0.85 | 1.15 | 1.13 | Comparative Example |
| 7 | 1.0 | 0.21 | 0.003 | 0.32 | 904 | 6.24 | 678 | 0.85 | 1.24 | 1.25 | Comparative Example |
| 8 | 1.0 | 0.35 | 0.003 | 0.46 | 921 | 10.85 | 798 | 0.86 | 1.34 | 1.32 | Invention |
| 9 | 1.0 | 0.46 | 0.003 | 0.57 | 935 | 13.84 | 896 | 0.88 | 1.13 | 1.09 | Comparative Example |
| 10 | 1.1 | 0.36 | 0.001 | 0.47 | 920 | 15.32 | 801 | 0.86 | 1.33 | 1.31 | Invention |
| 11 | 1.1 | 0.36 | 0.005 | 0.48 | 920 | 8.92 | 804 | 0.86 | 1.28 | 1.29 | Invention |
| 12 | 1.1 | 0.36 | 0.041 | 0.58 | 926 | — | — | — | — | — | Comparative Example |
| 13 | 1.2 | 0.36 | 0.002 | 0.49 | 919 | 18.74 | 798 | 0.87 | 1.40 | 1.38 | Invention |
| 14 | 1.2 | 0.33 | 0.002 | 0.46 | 915 | 9.73 | 780 | 0.86 | 1.27 | 1.27 | Invention |

Q = [0] + 2.77*[N] + 0.1*[Fe]

XTD: On the (0002) pole figure by X-ray diffraction of sheet surface, the height of the peak of relative X-ray intensities within an azimuth angle inclined by 0 to 10° toward the sheet normal direction from the sheet width direction and an azimuth angle rotated by ±10° from the sheet width direction around the sheet normal direction.

XND: On the (0002) pole figure by X-ray diffraction of sheet surface, the height of the peak of relative X-ray intensities within an azimuth angle inclined by 0 to 30° toward the sheet width direction from the sheet normal direction and an azimuth angle rotated about the entire circumference around the sheet normal direction.

In Table 1, Test Nos. 1 and 2 show the results of an α+β titanium alloy produced by the process where hot rolling also includes rolling in the sheet width direction. In both of Test Nos. 1 and 2, the hardness anisotropy index is 0.85 or less and the deformation resistance during the cold rolling is high, whereby it is difficult to increase the cold rolling reduction.

Further, the fracture inclination index is considerably lower than 1.20 and the fracture path in the sheet width direction is short, whereby a sheet fracture is liable to occur. In both of these materials, the value of XTD/XND falls below 5.0 and T-texture is not developed.

In contrast thereto, in Test Nos. 4, 5, 8, 10, 11, 13 and 14, which are Examples of the hot-rolled sheet according to the present invention produced by the production process according to the present invention, the hardness anisotropy index is 0.85 or more so as to exhibit good cold rollability, and the fracture inclination index exceeds 1.20, so as to reveal that the material has a property of causing a crack to be slanted toward the sheet width direction, and is insusceptible to sheet fracture. Here, the hardness was evaluated by the Vickers hardness in accordance with JIS Z2244.

On the other hand, in Test Nos. 3 and 7, the strength is low as compared with those of other materials and a tensile strength of 700 MPa generally required of an α+β titanium alloy is not achieved.

Of these examples, in Test No. 3 where the amount of Fe to be added falls below the lower limit of the amount of Fe to be added in the hot-rolled sheet according to the present invention, the tensile strength is low. Further, in Test No. 7 where the nitrogen and oxygen contents are low in particular, and the oxygen equivalent value Q falls below the lower limit of the specified amount, the tensile strength thereof does not reach a sufficiently high level.

In Test Nos. 6 and 9, the X-ray anisotropy index exceeds 5.0 and, the hardness anisotropy index also exceeds 0.85, but the inclination index falls below 1.20, so that fracture is liable to develop in the sheet width direction.

In Test Nos. 6 and 9 where the amount of Fe to be added and the Q value exceed respective upper limits of the present invention, the strength thereof is too much increased so that the ductility is decreased, whereby a crack in the sheet width direction is less liable to be slanted by plastic relaxation.

In Test No. 12, a lot of defects were generated in many portions of the hot-rolled sheet and the yield of the product was low, so that the characteristics could not be evaluated. This is because N was added in excess of the upper limit of the present invention by a normal method using a high N-content sponge titanium as a melting material, so as to produce many LDI.

As understood from these results, in a titanium alloy sheet having the chemical compositions and XTD/XND specified in the present invention, a crack in the sheet width direction is inclined to prolong the path and sheet fracture is less liable to occur, and due to the low deformation resistance during the cold rolling and the easiness of deformation in the sheet longitudinal direction. Accordingly, the cold rollability thereof is excellent, but when the alloying element amounts and XTD/XND fall outside the ranges specified in the present invention, the strong material anisotropy and excellent cold rollability associated with the present invention, such as insusceptibility to sheet fracture in the sheet width direction, cannot be satisfied.

Example 2

Each of the materials of Test Nos. 4, 8 and 14 in Table 1 was hot-rolled under various conditions as shown in Tables 2 to 4, and then pickled so as to remove oxide scale. Thereafter, the tensile characteristics were examined and, the degree of texture growth was evaluated by using, as the X-ray anisotropy index, the ratio XTD/XND between, on the (0002) pole figure of titanium of X-ray diffraction (using RINT 2500, mfd. by Rigaku Corporation; Cu—Kα, voltage: 40 kV, current: 300 mA), the peak value XTD of relative X-ray intensities within an azimuth angle inclined by 0 to 10° toward the sheet normal direction from the sheet width direction, and an azimuth angle rotated by ±10° from the sheet width direction around the sheet normal direction; and the peak value XND of relative X-ray intensities within an azimuth angle inclined by 0 to 30° toward the sheet width direction from the sheet normal direction and an azimuth angle rotated about the entire circumference around the sheet normal line.

When the hardness anisotropy index is 0.85 or more, the deformation resistance in the sheet thickness direction is small and therefore, the cold rollability thereof is good.

An impact test was performed at ordinary temperature in accordance with JIS 22242 by using Charpy impact test pieces (with a 2-mm V-notch) sampled in the L direction from a hot-rolled sheet and a cold-rolled sheet having a sheet thickness reduction ratio of 40%, and then the insusceptibility to sheet fracture was evaluated by the ratio (fracture inclination index: b/a) between the length (b) of a fracture path and the length (a) of a perpendicular line drawn down from the V-notch bottom.

When the fracture inclination index exceeds 1.20, the fracture path of a crack in the sheet width direction becomes sufficiently long and sheet fracture is less liable to occur. For the evaluation of the easiness of deformation in the sheet thickness direction of the hot-rolled sheet, the hardness anisotropy index was used. The hardness was evaluated by the Vickers hardness at a load of 1 kgf in accordance with JIS 22244. When the hardness anisotropy index is 15,000 or more, the recoiling property is good. The results of these characteristic evaluations are shown in Tables 2 to 4.

TABLE 2

| Test No. | Sheet Thickness Reduction Ratio (%) | Heating Temperature prior to Hot Rolling (° C.) | Hot-Rolling Finishing Temperature (° C.) | X-Ray Anisotropy Index (XTD/XND) | Tensile Strength in Sheet Longitudinal Direction | Hardness Anisotropy Index | Fracture Inclination Index (hot-rolled sheet) | Fracture Inclination Index (40% cold-rolled sheet) | Remarks |
|---|---|---|---|---|---|---|---|---|---|
| 15 | 92.3 | 930 | 801 | 13.56 | 776 | 0.87 | 1.28 | 1.28 | Invention |
| 16 | 95.6 | 960 | 813 | 10.62 | 768 | 0.87 | 1.27 | 1.27 | Invention |
| 17 | 86.1 | 970 | 798 | 7.54 | 798 | 0.86 | 1.12 | 1.13 | Comparative Example |
| 18 | 92.8 | 880 | 721 | 2.87 | 813 | 0.84 | 1.06 | 1.04 | Comparative Example |

TABLE 2-continued

| Test No. | Sheet Thickness Reduction Ratio (%) | Heating Temperature prior to Hot Rolling (° C.) | Hot-Rolling Finishing Temperature (° C.) | X-Ray Anisotropy Index (XTD/XND) | Tensile Strength in Sheet Longitudinal Direction | Hardness Anisotropy Index | Fracture Inclination Index (hot-rolled sheet) | Fracture Inclination Index (40% cold-rolled sheet) | Remarks |
|---|---|---|---|---|---|---|---|---|---|
| 19 | 95.1 | 1120 | 930 | 2.75 | 806 | 0.85 | 1.03 | 1.06 | Comparative Example |
| 20 | 93.4 | 935 | 695 | 1.55 | 809 | 0.83 | 1.07 | 1.09 | Comparative Example |
| 21 | 92.0 | 1040 | 905 | 1.34 | 811 | 0.84 | 1.08 | 1.10 | Comparative Example |

The β transformation point is 926° C.

TABLE 3

| Test No. | Sheet Thickness Reduction Ratio (%) | Heating Temperature prior to Hot Rolling (° C.) | Hot-Rolling Finishing Temperature (° C.) | X-Ray Anisotropy Index (XTD/XND) | Tensile Strength in Sheet Longitudinal Direction (MPa) | Hardness Anisotropy Index (HV1(Z)/HV1(T)) | Fracture Inclination Index (hot-rolled sheet) | Fracture Inclination Index (40% cold-rolled sheet) | Remarks |
|---|---|---|---|---|---|---|---|---|---|
| 22 | 94.1 | 930 | 801 | 17.61 | 784 | 0.87 | 1.31 | 1.32 | Invention |
| 23 | 95.6 | 950 | 821 | 8.31 | 801 | 0.87 | 1.28 | 1.27 | Invention |
| 24 | 80.4 | 960 | 779 | 6.81 | 785 | 0.86 | 1.12 | 1.11 | Comparative Example |
| 25 | 91.9 | 860 | 704 | 3.45 | 801 | 0.84 | 10.5 | 1.06 | Comparative Example |
| 26 | 96.1 | 1090 | 930 | 3.10 | 803 | 0.85 | 1.04 | 1.05 | Comparative Example |
| 27 | 92.8 | 930 | 685 | 2.31 | 805 | 0.83 | 1.07 | 1.08 | Comparative Example |
| 28 | 91.4 | 1035 | 885 | 2.60 | 812 | 0.84 | 1.08 | 1.08 | Comparative Example |

The β transformation point is 921° C.

TABLE 4

| Test No. | Sheet Thickness Reduction Ratio (%) | Heating Temperature prior to Hot Rolling (° C.) | Hot-Rolling Finishing Temperature (° C.) | X-Ray Anisotropy Index (XTD/XND) | Tensile Strength in Sheet Longitudinal Direction (MPa) | Hardness Anisotropy Index (HV1(Z)/(HV1(T)) | Fracture Inclination Index (hot-rolled sheet) | Fracture Inclination Index (40% cold-rolled sheet) | Remarks |
|---|---|---|---|---|---|---|---|---|---|
| 29 | 92.3 | 940 | 801 | 10.68 | 786 | 0.88 | 1.34 | 1.35 | Invention |
| 30 | 97.5 | 950 | 812 | 9.72 | 791 | 0.87 | 1.32 | 1.30 | Invention |
| 31 | 82.4 | 970 | 824 | 6.39 | 778 | 0.86 | 1.05 | 1.07 | Comparative Example |
| 32 | 95.6 | 855 | 715 | 2.45 | 793 | 0.83 | 1.04 | 1.06 | Comparative Example |
| 33 | 94.8 | 1120 | 930 | 2.61 | 802 | 0.84 | 1.03 | 1.04 | Comparative Example |
| 34 | 95.3 | 925 | 687 | 1.64 | 779 | 0.83 | 1.02 | 1.04 | Comparative Example |
| 35 | 91.3 | 1050 | 880 | 1.32 | 792 | 0.83 | 1.03 | 1.04 | Comparative Example |

The β transformation point, is 915° C.

Tables 2, 3 and 4 show the evaluation results of hot-roiled annealed sheets having chemical compositions of Test Nos. 4 and 8. In Test Nos. 15, 16, 22, 23, 29 and 30 which are Examples of the hot-rolled sheet according to the present invention produced by the production process according to the present invention, the hardness anisotropy index is 0.85 or more and, the fracture inclination index exceeds 1.20, so as to reveal that the sheet has good cold rollability and insusceptibility to sheet fracture.

On the other hand, in Test Nos. 17, 24 and 31, the fracture inclination index falls below 1.20, and accordingly the sheet fracture is liable to occur. This is because the sheet thickness reduction ratio during the hot rolling is lower than the lower limit of the present invention and T-texture cannot grow sufficiently, to thereby produce a state where a crack in the sheet width direction readily develops straight in the sheet width direction.

In Test Nos. 18, 19, 20, 21, 25, 26, 27, 28, 31, 32, 33 and 34, the X-ray anisotropy index falls below 5.0, the hardness anisotropy index is 0.85 or less, and the fracture inclination index also falls below 1.20.

Among these, all of Test Nos. 18, 25 and 32 where the heating temperature prior to the hot rolling falls below the lower limit temperature of the present invention, and Test Nos. 20, 27 and 34 where the hot-rolling finishing temperature fall below the lower limit temperature of the present invention are an example failing in achieving adequate hot rolling in the α+β two-phase region with a sufficiently high β phase fraction and in satisfying sufficient development of T-texture.

All of Test Nos. 19, 26 and 33 where the heating temperature prior to the hot rolling exceeds the upper limit temperature of the present invention, and Test Nos. 21, 28 and 35 where the hot-rolling finishing temperature exceeds the upper limit temperature of the present invention are an example in which most of hot working is performed in the single-phase region, and the non-growth or destabilization of T-texture and the formation of a final coarse microstructure are associated with hot rolling of a coarse β grain, whereby neither increase in the hardness anisotropy index nor elongation of the fracture path are achieved.

As understood from the above results, an α+β titanium alloy sheet ensuring high productivity and having a property such that fracture in the sheet width direction is less liable to occur in a coil during or after cold rolling and, cold rolling is facilitated thereby, can be produced by subjecting a titanium alloy having the texture and chemical composition specified in the present invention to hot rolling in the ranges of sheet thickness reduction ratio, heating temperature prior to hot rolling and finishing temperature of the present invention so as to impart a property of, for example, easily causing a crack in the sheet width direction to be slanted and of exhibiting low deformation resistance in the sheet thickness direction.

INDUSTRIAL APPLICABILITY

As described in the foregoing pages, the present invention can provide an α+β titanium alloy sheet ensuring that sheet fracture due to development of edge cracking is less liable to occur, for example, during the cold rolling or in the uncoiling step after cold rolling and, the deformation resistance thereof during the cold rolling is lowered, so as to maintain a high sheet thickness reduction ratio. The present invention can be used widely in consumer application such as golf club face, in automotive component application and in other applications and therefore, the present invention has high industrial applicability.

DESCRIPTION OF REFERENCE NUMERALS

1: Charpy impact test piece
2: Notch
3: Notch bottom
a: Length of perpendicular line drawn down from notch bottom
b: Length of actual fracture path

The invention claimed is:

1. An α+β titanium alloy sheet, wherein:

(a) a normal direction of a hot-rolled sheet is taken as ND, a hot rolling direction is taken as RD, a hot-rolling width direction is taken as TD, a normal direction of the α-phase (0001) plane is taken as c-axis orientation, an angle formed between the c-axis orientation and the ND is taken as θ, and an angle formed between a plane including the c-axis orientation and the ND, and a plane including the ND and the TD is taken as Φ;

(b1) among (0002) relative reflection intensities of X-ray by a crystal grain where θ is 0° or more and 30° or less, and Φ falls in the entire circumference of −180° to 180, a maximum relative reflection intensity is taken as XND;

(b2) among (0002) relative reflection intensities of X-ray caused by a crystal grain where θ is 80° or more and less than 100°, and Φ falls in ±10°, the maximum relative reflection intensity is taken as XTD; and (c) XTD/XND is 5.0 or more, wherein the α+β titanium alloy sheet comprises, in mass %, Fe: 0.8 to 1.5% and N: 0.020% or less, and contains O, N and Fe to satisfy the condition that Q, in %, defined by the following formula 1 is 0.34 to 0.55, with the balance being Ti and unavoidable impurities:

$$Q=[O]+2.77\cdot[N]+0.1\cdot[Fe] \quad \text{Formula 1}$$

wherein [O] is a content, in mass %, of O, [N] is a content, in mass %, of N, and [Fe] is a content, in mass %, of Fe.

2. A process for producing the α+β titanium alloy sheet according to claim 1, wherein:

at the time of hot-rolling an α+β titanium alloy, the titanium alloy before hot rolling is heated to a temperature ranging from not lower than β transformation temperature +20° C. to not higher than β transformation point +150° C., and is hot-rolled uni-directionally by setting the hot rolling finishing temperature to be not lower than β transformation temperature −200° C. and not higher than β transformation temperature −50° C., such that the sheet thickness reduction ratio, in %, defined by the following formula becomes 90% or more:

Sheet thickness reduction ratio={(sheet thickness before cold rolling−sheet thickness after cold rolling)/(sheet thickness before cold rolling)}·100.

* * * * *